US005657846A

United States Patent [19]

Schwartz

[11] Patent Number: 5,657,846

[45] Date of Patent: Aug. 19, 1997

[54] CURRENCY VALIDATOR WITH SPLIT HOUSING

[75] Inventor: Vladimir A. Schwartz, Kiev, Ukraine

[73] Assignee: Cashcode Company Inc., Concord, Canada

[21] Appl. No.: 502,023

[22] Filed: Jul. 13, 1995

[51] Int. Cl.[6] ..... G07F 7/04

[52] U.S. Cl. ..... 194/206

[58] Field of Search ..... 194/206, 207, 194/345; 209/534

[56] References Cited

U.S. PATENT DOCUMENTS 4,784,274 11/1988 Mori et al. ..... 209/534

FOREIGN PATENT DOCUMENTS 5-258147 10/1993 Japan ..... 194/206

*Primary Examiner*—F. J. Bartuska

[57] ABSTRACT

An improved currency validator drives a bill to be validated along an enclosed path past a number of sensors for validating the bill. The enclosed path is defined between a fixed portion of the validator and two hinged portions. The two hinged portions are movable to a service position thereby exposing the path and allowing access to components in the fixed portion and components in the hinged portions. Preferably the hinged components are latched to each other and enclose the path at an intermediary point of the path.

14 Claims, 3 Drawing Sheets

CURRENCY VALIDATOR WITH SPLIT HOUSING

FIELD OF THE INVENTION

The present invention relates to currency validators and in particular to currency validators having a split housing to allow improved access to the interior of the unit.

BACKGROUND OF THE INVENTION

Currency validators continue to gain wide acceptance and are used in many applications ranging from use in association with vending machines to use in association with casinos. Most currency validators have a processing unit which receives the bill, performs certain validation steps and then stores the bill in a stacker arrangement or a security box. The bill is fed along an enclosed path on route to the security box and the various validation tests are carried out as the bill moves along the path.

The processing unit of the currency validators are designed with one portion of the processing unit being generally fixed and a second portion of the processing unit being hinged to allow access to the enclosed path. Service of the processing unit is carried out by movement of the hinged portion to an open service position exposing the enclosed path whereby jammed bills can be removed. In the service position, various components of the processing unit, such as the drive wheels and sensing arrangement, can be serviced.

Currency validators preferably are of a design to be reversibly mounted. For example, the currency validator can be mounted in either an up or a down position. This provides improved flexibility with respect to the area in which the validator is being installed. Existing currency validators do not always make it convenient to access the enclosed path in both an up and a down orientation of the validator.

SUMMARY OF THE INVENTION

The present invention relates to improvements in currency validators and in particular provides a currency validator where access to the interior of the processing unit is more convenient.

A currency validator according to the present invention comprises means for introducing a bill into the currency validator, means for driving an introduced bill along an enclosed path past a number of sensors to evaluate whether the bill is valid, a security box for receiving the bills which are determined to be valid, with the security box being positioned at an end of the path such that a validated bill is driven along the path and enters the security box. The path includes two main segments at an angle to one another and joined by a small curved transition. The processing unit on one side of the path has a fixed structure defining one boundary of the path and the processing unit has two hinged segments defining the opposite boundary of the path. The hinged segments are movable from a first position where the segments cooperate to define the opposite boundary of the path to a second position where the segments are in a service position allowing full access to the path. It has been found that by providing two hinged segments, improved access to the enclosed path is obtained for the common mounting orientations of the currency validator.

According to an aspect of the invention, each of the hinged segments in the first position are releasably connected, one to the other, adjacent the curved transition.

According to yet a further aspect of the invention, the hinged segments essentially define the entire opposite boundary of the path.

According to yet a further aspect of the invention, each of the hinged segments rotate in a direction opposite to the other when moved towards said first position or towards the second position.

According to yet a further aspect of the invention, each hinged segment is rotated through an angle of at least about 45° when moving from the first orientation to the second orientation.

A currency validator according to the present invention comprises a face plate with a slot therein for introducing a bill into the validator. The validator includes means for moving a received bill along a validating path past a number of sensors for evaluating the validity of the received bill. A security box at the end of the path opposite the slot receives and stores the validated bills. The path is defined between a fixed housing on one side of the path and two hinged segments on an opposite side of the path. The hinged segments in a first position cooperate to enclose the path on the opposite side and the segments are rotatable to a second position exposing said path for service.

In a preferred aspect of the invention, each hinged segment includes a hinged end and a free end and the free ends of the segments releasably latch to one another and to the validator to maintain the segments in an operating configuration.

According to a further aspect of the invention, one of the hinged segments is hinged to the validator adjacent the security box and the other hinged segment is hinged to the processing unit adjacent the bill inlet.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
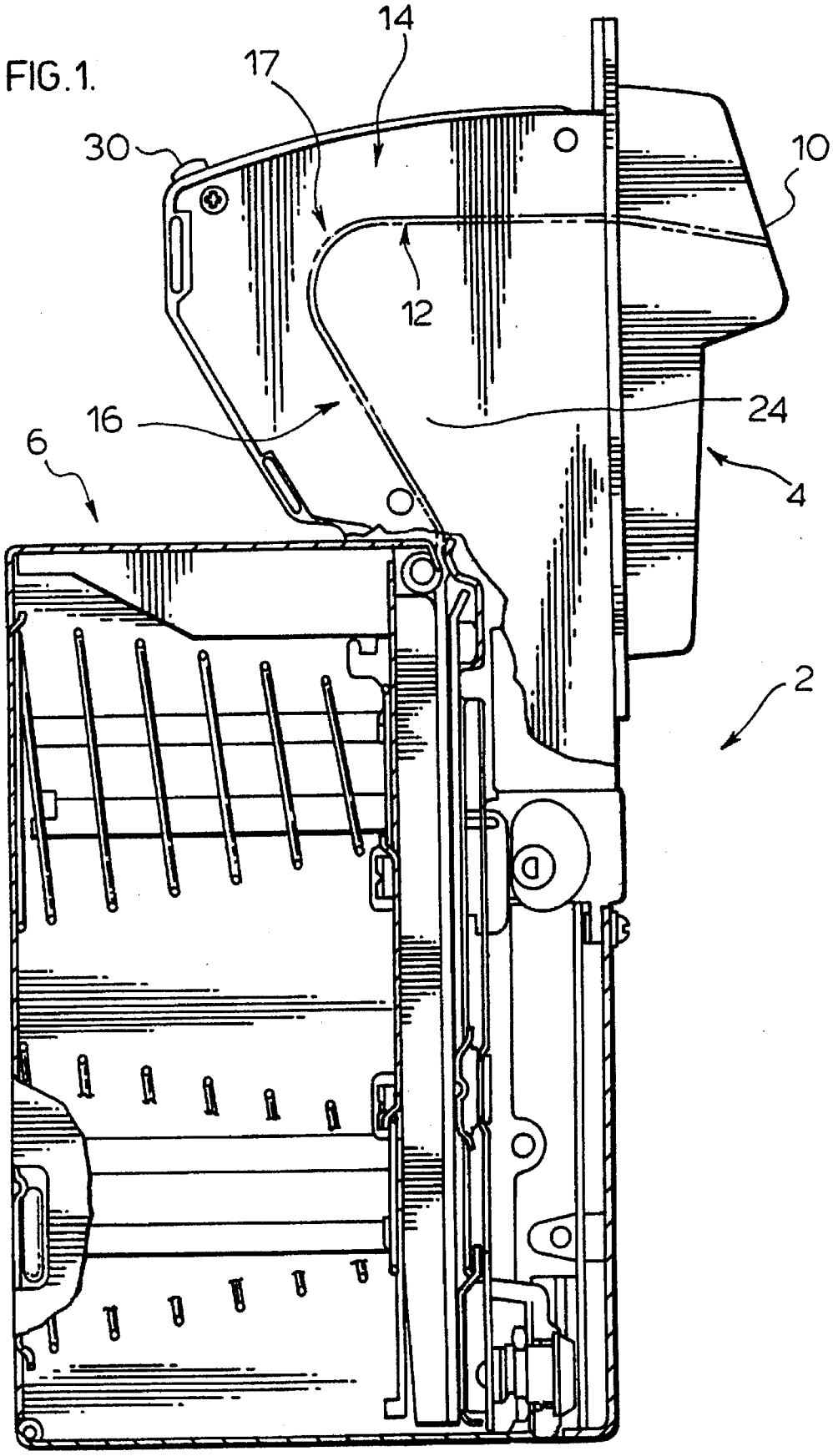
FIG. 1 is a partial sectional view illustrating the enclosed path of the processing unit in combination with a security box in the form of a stacking arrangement.

The currency validator 2 includes a processing unit 4 and a security box 6. The security box is typically releasably secured to the processing unit. A bill passes through a front inlet 10 in the processing unit 4 and is moved along an enclosed path 12 and eventually will be received in the security box 6 if it is appropriately validated. If it is not validated, it will be driven back out through the inlet 10. The enclosed path divides the processing unit into a fixed structure 24 to one side of the enclosed path 12 with two hinged segments 26 and 28 located to the opposite side of the enclosed path. These hinged segments are latched by latch 30 adjacent the curved transition 17 of the enclosed path. As a bill is driven along the enclosed path, it will move past a sensing unit, generally shown as 20, which determines whether the bill is valid. The bill is driven by drive wheels 18.

With validators, it can be appreciated that access to the enclosed path is necessary to remove jammed bills and/or to service and clean the drive arrangement and the various sensing units positioned along the enclosed path.

Figure 2:
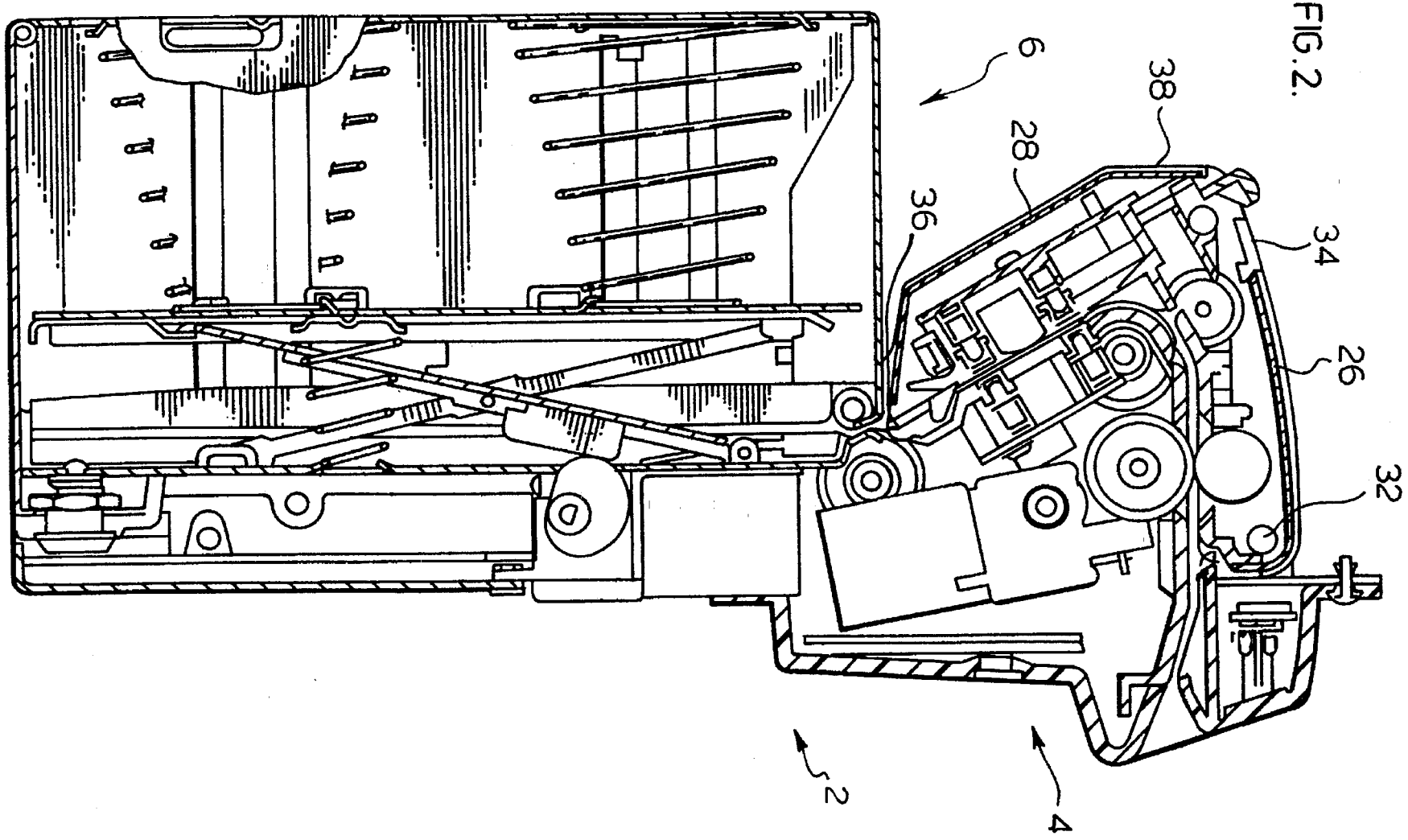
FIG. 2 is a cross sectional view similar to FIG. 1 showing various components of the bill validator.
Figure 3:
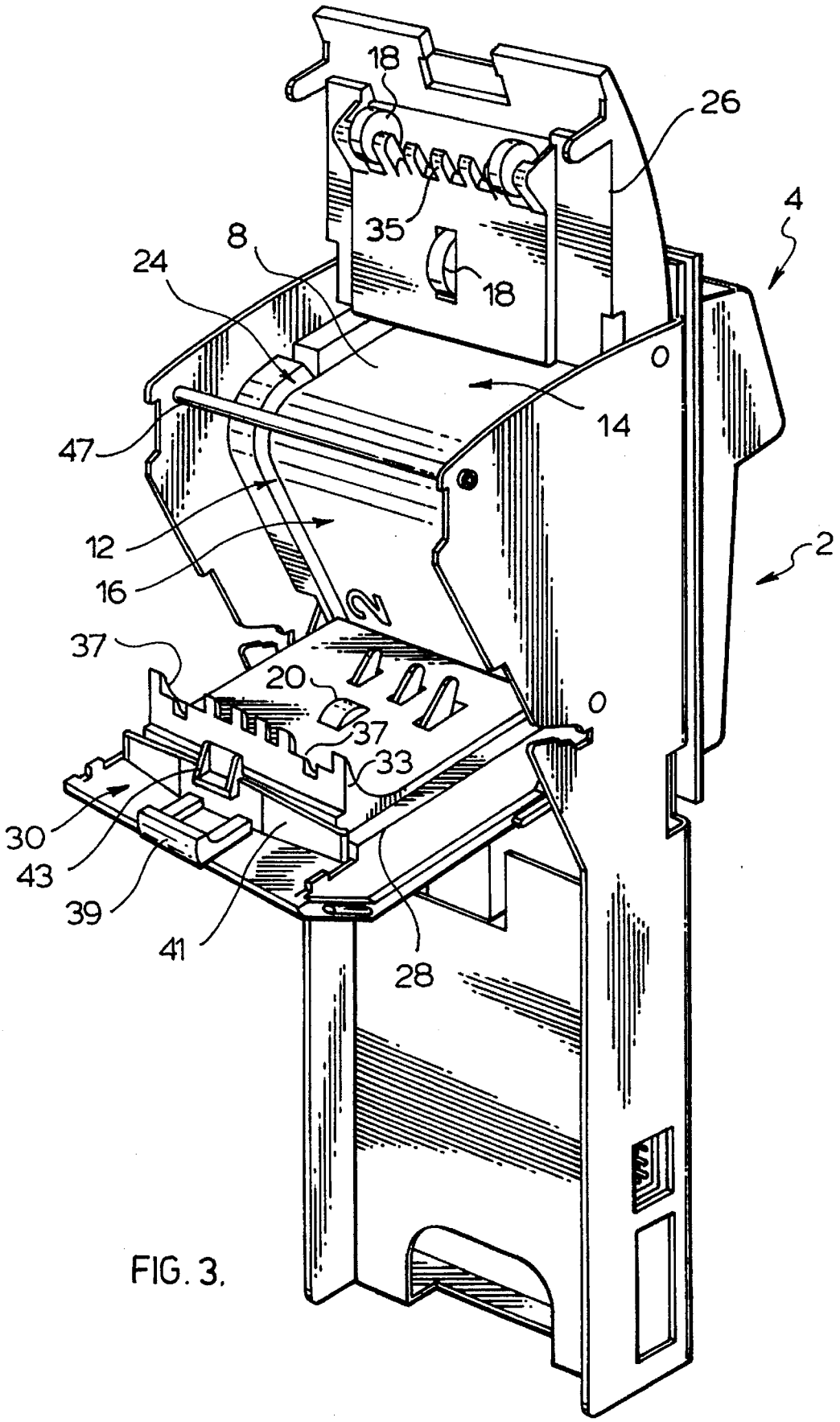
FIG. 3 is a perspective view showing the hinged segments in an open service position.

The first segment, as shown in FIGS. 2 and 3, is generally hinged adjacent 32 and this is at an end of the enclosed path adjacent the bill inlet 10. The second segment 28 is hinged at 36 at an opposite end of the enclosed path adjacent the security box 4. These hinged segments are movable from the closed position of FIGS. 1 and 2 to an open service position, as generally shown in FIG. 3. The second segment 28 includes various sensing mechanisms 20, which analyse the bill as it is moved along the second segment 16 of the enclosed path. The enclosed path does include a first, generally straight segment 14 joined by curved transition 17 to the second segment 16. To facilitate smooth guidance of a bill from the first to the second segment of the path, the second hinged segment 28 includes a curved moulded portion 33 which in effect defines the curved transition. This transition cooperates with fingers 35 on the first hinged segment 26 to avoid jamming of bills as they move through the transition portion. It can be seen that the moulded segment 33 also includes slotted areas 37 either side thereof for accommodating the pressure wheels 18 attached to the first segment 26 which cooperate with drive wheels 17 mounted on the fixed structure 24.

The latch 30 includes an actuator 39 attached to the spring arm 41, which is held either side of the second segment 28. The spring arm 41 urges the latch member 43 to a locked position where the latch engages bar 47 and the first segment 26. Actuator 39, when depressed, forces the latch to a clear position and allows the two hinged segments 26 and 28 to be released from each other. The actuator 39 and the spring arm 41 are moulded of a single plastic unit.

As can be appreciated from FIG. 3, the hinged segments 26 and 28 make access to the enclosed path 12 readily available regardless of whether the validator is mounted in the up position of FIG. 3 or in a downwardly orientated position which would be the reverse thereof. As the hinged segments latch generally at the curved transition, one of the hinged segments is rotated upwardly and the other hinged segment is rotated downwardly. It can be seen that each of the hinged segments rotate through an angle of at least 45° and in the case of the first hinged segment 26, rotates through approximately 90°. Also it can be appreciated that the latch, because it is centrally located at the curved transition, remains easily available in both mounting orientations of the validator and the access to the latch is not dependent upon the mounting orientation of the validator. The latch 43 basically engages the bar 47 and also serves to lock the first hinged segment 26 in the operating configuration. The end of the actuator 39 serves to maintain the first hinged segment in position and is only movable to the service position of FIG. 3 after the second hinged segment has been rotated towards the service position.

It has been found that the currency validator as disclosed herein is very convenient to use, allows excellent access to the various components of both the fixed segment 24 and components mounted in the hinged segments 26 and 28. The enclosed path defines an acute angle and if the segments 26 and 28 were a single injection moulded piece, it would be a fairly complicated and expensive part to manufacture. By splitting this portion generally at the transition into two parts, the cost of manufacture is reduced. By providing such an arrangement, improved access in both an up and a down mounting orientation of the validator is achieved.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A currency validator for validating bills comprising an inlet for introducing a bill into said currency validator, means for driving an introduced bill along an enclosed path past a number of sensors to evaluate whether the bill is valid, a security box for receiving bills which are determined to be valid, said security box being positioned at an end of said path such that a validated bill driven along the path enters said security box, said path including two main segments at an angle to one another and joined by a curved transition, said validator to one side of said path having a fixed structure defining one boundary of said path between said inlet and said end of said path adjacent said security box, said validator at a position opposite said fixed structure having an opposite boundary of said path defined by two hinged segments, said hinged segments in a first position cooperating with said fixed structure to define said path between said fixed structure and said hinged segments, said hinged segments being movable to a second position where said segments are in a service position exposing said main segments and said curved transition of said path for service.

2. A currency validator as claimed in claim 1 wherein said segments in said first position are releasably connected one to the other at said transition.

3. A currency validator as claimed in claim 2 said segments essentially define the entire opposite boundary of said path.

4. A currency validator as claimed in claim 3 wherein said hinged segments rotate in opposite direction when moved towards said first position or towards said second position.

5. A currency validator as claimed in claim 4 wherein each hinged segment is rotatable through an angle of at least 45°.

6. A currency validator as claimed in claim 5 wherein one of said segments is hinged at an end of said path adjacent said means for introducing a bill into said validator and the other segment is hinged to said validator adjacent to said security box.

7. A currency validator comprising a face plate with a slot therein for introducing a bill into said validator, means for moving a received bill along a validating path past a plurality of sensors for evaluating the validity of the received bill, a security box at an end of said path opposite said slot which receives and stores validated bills, said path being defined between a fixed housing on one side of said path and two hinged segments on an opposite side of said path, said hinged segments in a first position cooperating to enclose said path on said opposite side and said segments being rotatable to a second position exposing said path for service, and wherein each segment includes a hinge end and a free end and said free ends when said segments are in said first position abut and are releasably held one to the other.

8. A currency validator as claimed in claim 7 wherein said path includes a transition of at least about 90° and said segments are located to opposite sides of said transition.

9. A currency validator as claimed in claim 7 wherein one of said segments is hinged to the validator adjacent said security box and the other segment is hinged adjacent said slot.

10. A currency validator as claimed in claim 7 wherein said segments rotate in opposite direction when moved from said first position to said second position or when moved from said second position to said first position.

11. A currency validator as claimed in claim 9 wherein said segments rotate in opposite direction when moved from said first position to said second position or when moved from said second position to said first position.

12. A currency validator comprising a face plate with a slot therein for introducing a bill into said validator, means for moving a received bill along a validating path past a plurality of sensors for evaluating the validity of the received bill, a security box at an end of said path opposite said slot which receives and stores validated bills, said path being defined between a fixed housing on one side of said path and two hinged segments on an opposite side of said path, said hinged segments in a first position cooperating to enclose said path on said opposite side and said segments being rotatable to a second position exposing said path for service, and wherein said path includes a transition of at least about 90° and said segments are located to opposite sides of said transition, and each segment includes a hinge end and a free end and said free ends when said segments are in said first position abut and are releasably held one to the other.

13. A currency validator as claimed in claim 12 wherein one of said segments is hinged to the validator adjacent said security box and the other segment is hinged adjacent said slot.

14. A currency validator as claimed in claim 13 wherein said segments rotate in opposite direction when moved from said first position to said second position or when moved from said second position to said first position.

* * * * *